United States Patent [19]

Bershak

[11] Patent Number: 4,669,996

[45] Date of Patent: Jun. 2, 1987

[54] RECREATIONAL FLYING RING HAVING PRIMARY AND SECONDARY AIRFOILS

[76] Inventor: William P. Bershak, 40 Horn Rd., Levittown, Pa. 19056

[21] Appl. No.: 785,213

[22] Filed: Oct. 7, 1985

[51] Int. Cl.[4] ..... A63H 27/00

[52] U.S. Cl. ..... 446/48

[58] Field of Search ..... 446/46, 48, 47; 273/425, 424, 428

[56] References Cited

U.S. PATENT DOCUMENTS

| | | | |
|---|---|---|---|
| 248,901 | 11/1881 | Wetherill | 273/425 |
| 1,991,689 | 2/1935 | McClintock | 273/425 X |
| 3,580,580 | 5/1971 | Wark | 273/425 |
| 3,765,122 | 10/1973 | English | 446/48 |
| 4,307,535 | 12/1981 | Martin | 446/48 |
| 4,456,265 | 6/1984 | Adler | 273/425 |
| 4,560,358 | 12/1985 | Adler | 273/425 |

OTHER PUBLICATIONS

"The Invention of the Frisbee", *Steven Caney's Invention Book,* pp. 97–102, © 1985, Workman Pub. Co., N.Y., N.Y.

*Primary Examiner*—Mickey Yu

*Attorney, Agent, or Firm*—Richard C. Woodbridge

[57] ABSTRACT

A recreational spinning ring includes a primary and secondary airfoil. The primary airfoil is located on the bottom of the ring near the outside rim and provides a downward force while it is in flight. An upward force is provided by the secondary airfoil located on the top surface of the ring closer to the inside edge. The downward force of the primary airfoil counterbalances the excess lift provided by the secondary airfoil so that sufficient net lift remains to keep the ring airborn. The improved flying ring has the ability to fly in an exceptionally straight path over intermediate and long range distances.

6 Claims, 4 Drawing Figures

RECREATIONAL FLYING RING HAVING PRIMARY AND SECONDARY AIRFOILS

CROSS-REFERENCE TO RELATED INVENTIONS

This application relates to U.S. patent application Ser. No. 376,770 filed Jul 26, 1982, now abandoned.

BACKGROUND OF THE INVENTION

1. Field of the Invention

The invention relates to a recreational flying ring having a primary and secondary airfoil.

2. Description of the Prior Art

The use of spinning discs or rings for recreational purposes is well known. Originally it was discovered that pie plates and the like made suitable aerial projectiles if launched with sufficient rotational velocity and forward speed. That was followed by plastic discs sometimes referred to as "flying saucers"or "Frisbees ®" that were designed specifically for play. A later development was to include a hole in the disc so that the apparatus had the general shape of a rim. Such a device is described in U.S. Pat. No. 3,580,580. There is a device made by Parker Brothers, Inc. known as the SKY-RO TM which does have the capability of traveling long distances. However, due to its structure and its excessive flexing and bending, it requires rather exceptional fine tuning in order to produce a proper straight flight. Therefore a need was noted for a flying saucer capable of medium to long range flights in a straight line. It is also noted that prior art structures exist having shapes similar to flying saucers but having entirely different functions. See, for example, U.S. Pat. No. 1,991,689 entitled METHOD OF MAKING QUOITS which discloses a solid metal quoit having a flying saucer like-shape. While the shape of the quoit is somewhat similar to a modern spinning aerial ring it is noted that the weight of its steel stock is such as to make the aerodynamic lift negligible compared to the downward force of gravity. An interesting discussion of prior art flying discs and rings can be found on pages 97–102 ("The Invention of the Frisbee") in a book entitled "Steven Caney's Invention Book" published by the Workman Publishing Company, Inc., N.Y., N.Y. 1985.

One of the major disadvantages of many prior art flying saucers is that they tend not to fly in a straight line. In contrast to the prior art, the present invention is capable of a generally straighter flight, especially over intermediate to long distances than has previously been known possible with other recreational flying discs or rings.

SUMMARY OF THE INVENTION

Briefly described the invention comprises an improved flying ring in which the excess lift created by a secondary airfoil is substantially counterbalanced by the downward force, created by a primary airfoil. The rounded portion of the primary airfoil is located on the underside of the apparatus near the outer rim and serves to produce a net downward thrust when the apparatus is spinning and moving in a straight line. The rounded portion of the secondary, or lifting airfoil, is located on the top of the ring and adjacent to the inside edge thereof. The top surface on the side opposite the rounded portion of the primary airfoil is flat as is the bottom surface of the ring opposite the rounded portion of the secondard airfoil so that the secondary airfoil is substantially concentric to the primary airfoil. Plastics such as polyethylene are preferably used to form the apparatus. It has been found that the improved flying ring has the ability to stay on an exceptionally straight path over medium to long range distances.

DETAILED DESCRIPTION OF THE PREFERRED EMBODIMENT

Figure 2:
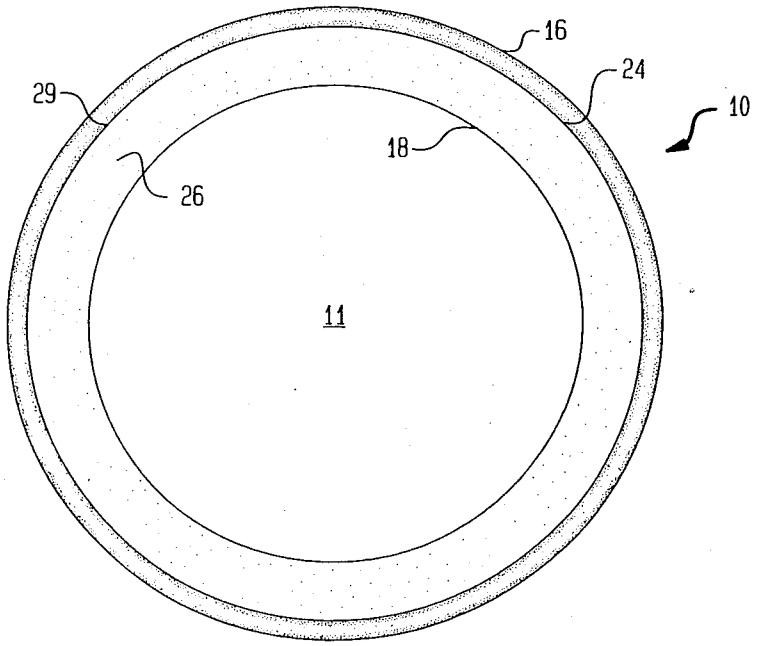
FIG. 2 is a bottom plan view of the preferred embodiment of the invention.

During the course of this description like numbers will be used to describe like elements according to the different figures which illustrate the invention.

The preferred embodiment of the invention 10 is illustrated in FIGS. 1 through 4. The geometry is defined by a top surface 12, a bottom surface 14, a leading edge 16 and a trailing edge 18. A hole or aperture 11 defines the central portion of the device. Bottom surface 14 includes a rounded portion 20 and a flat portion 26. Similarly, top surface 12 includes a flat portion 22 and a rounded portion 24. The rounded lower portion 20 in conjunction with the upper flat portion 22 form the primary airfoil 38. Similarly upper rounded portion 24 in combination with the flat lower section 26 form a secondary airfoil 40. Upper flat surface 22 of primary airfoil 38 changes into the rounded upper surface 24 of secondary airfoil 40 at a first transition point 28. Likewise, the lower rounded surface 20 of primary airfoil 38 changes into the flat lower surface 26 of secondary airfoil 40 at a second transition location 29. Upper transition point 28 may be vertically displaced from lower transition point 29. Upper flat section 22 is located generally opposite the lower rounded portion 20. Similarly, the lower flat section 26 is located generally opposite the upper rounded surface 24. The downward thrust produced by the primary airfoil 38 counterbalances the excess lift produced by the secondary airfoil 40 in such a fashion that there is a residual net upward lift to keep the ring in flight. Polyethylene is the preferred plastic material employed in embodiment 10, however, other suitable plastics such as Nylon ®, PVC, etc. may also be used.

Figure 4:
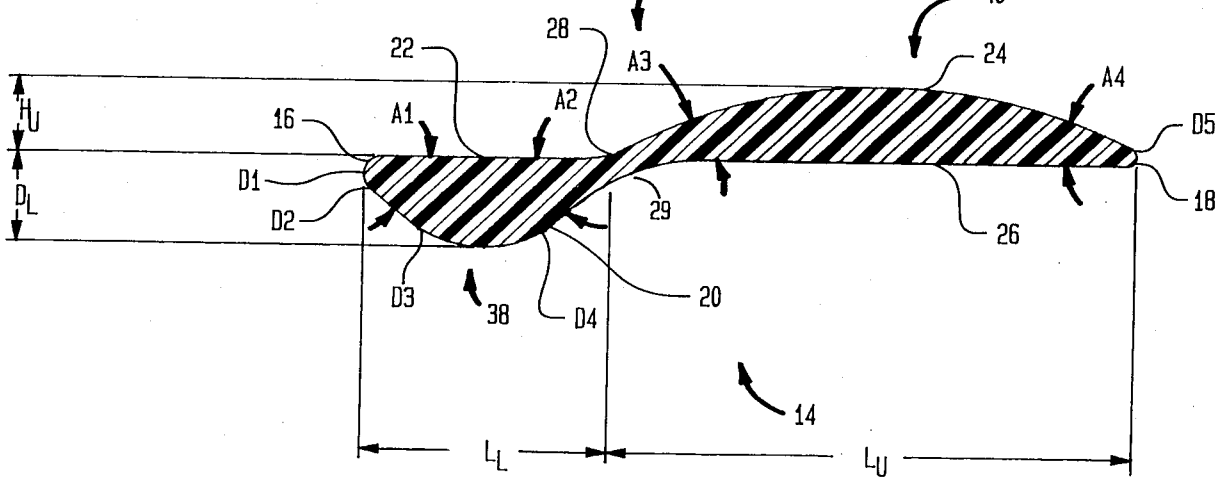
FIG. 4 is a magnified cross-sectional view of the preferred embodiment illustrated in FIG. 1 taken along line 4—4 in the direction of the arrows

The overall width of the cross-section of the preferred embodiment 10 as shown in FIG. 4 is 1⅛". The other parameters are as follows:

| PARAMETER | PREFERRED VALUE | ACCEPTABLE RANGE |
|---|---|---|
| $L_L$ | ⅜" | ¼" to ½" |
| $L_U$ | ⅞" | ⅝" to 1⅛" |
| $H_U$ | ⅛" | 1/16"to ⅜" |
| $D_L$ | ⅛" | 1/16"to ⅜" |
| D1 | 2/32" | 1/32" to ¼" |
| D2 | 3/32" | 1/32" to ¼" |
| D3 | 1/32" | 1/32" to ⅛" |
| D4 | 1/32" | 1/32" to ⅛" |
| D5 | 1/32" | 1/32" to ⅛" |
| A1 | 40° | 20° to 65° |
| A2 | 40° | 20° to 65° |
| A3 | 16° | 10° to 45° |

-continued

| PARAMETER | PREFERRED VALUE | ACCEPTABLE RANGE |
|---|---|---|
| A4 | 16° | 10° to 45° |
| Inside Diameter ($D_i$) | 8" | 4" to 16" |
| Outside Diameter ($D_o$) | $10\frac{1}{4}$" | $4\frac{1}{2}$" to $16\frac{1}{2}$" |
| Diameter to Transition point 28 ($D_T$) | $9\frac{3}{8}$" | $4\frac{1}{8}$" to $16\frac{1}{8}$" |
| Cross Section Width $L_L + L_U$ | $1\frac{1}{8}$" | $\frac{1}{2}$" to 3" |

Figure 1:
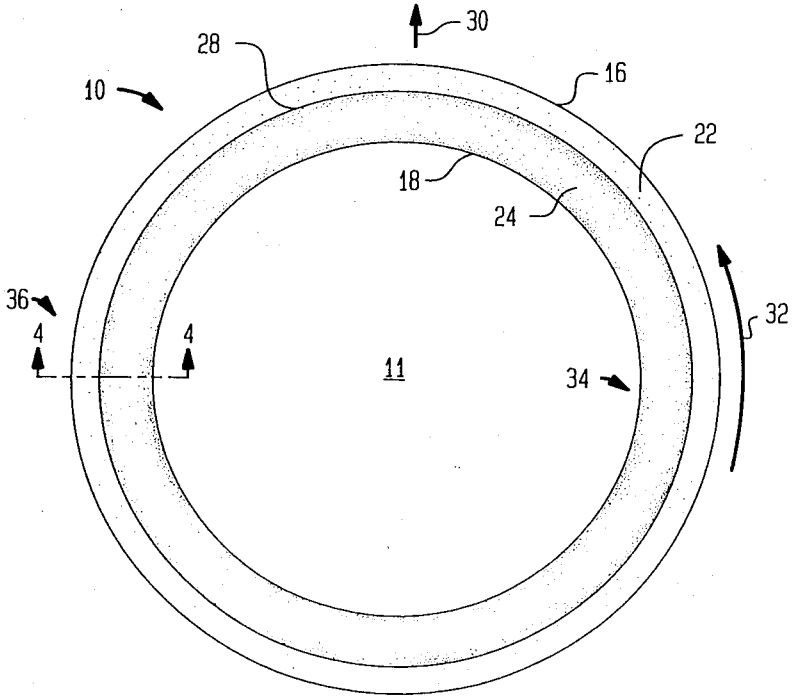
FIG. 1 is a top plan view of the preferred embodiment of the invention.
Figure 3:
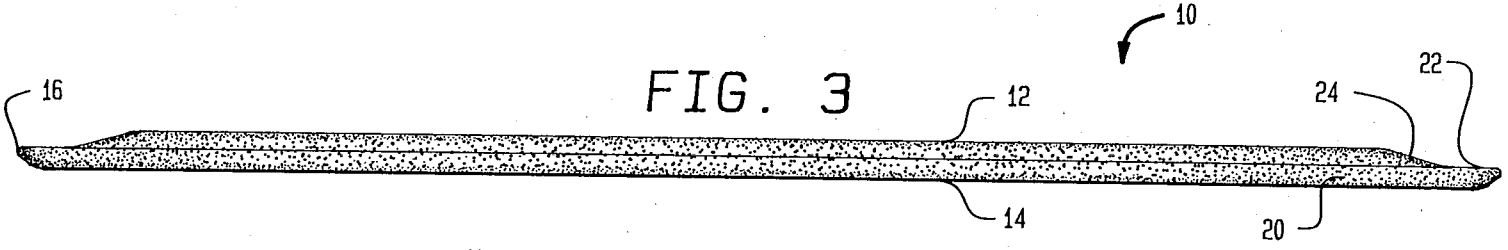
FIG. 3 is a side elevational view of the preferred embodiment illustrated in FIG. 1.

FIG. 1 shows the preferred embodiment 10 traveling in a direction 30 while spinning in a counterclockwise direction 32. This causes the advancing section 34 to act as the working side of the ring 10 while the retreating section 36 acts as the loafing side. If the ring were spinning clockwise in the direction opposite to that shown in FIG. 1, then side 36 would be the working side and side 34 would be the loafing side. The purpose of arranging the airfoil in the manner described is so that the downward force created by the primary airfoil 38 substantially counterbalances the excess lift produced by the secondary airfoil 40 on the top side 12 of the ring 10.

The secondary airfoil section 40 produces more lift on the working side 34 of the ring because the working side 34 is advancing into the wind thereby causing higher speed of airflow velocity to pass over the secondary airfoil 40 on the working side 34 thereby increasing lift on the working side 34. The purpose of the primary airfoil 38 is to produce a substantially equal but opposite downward thrust thereby neutralizing excess lift on the working side so that a net lift is left to keep the airfoil airborn.

As previously discussed it is noted that lower transition point 29 may be located vertically offset from upper transition point 28. However, it will be noted that the secondary airfoil section 40 is substantially, though not entirely, eccentric with respect to the primary airfoil section 38 as can be seen from FIG. 4. The amount of upward and downward thrust produced by primary airfoil 38 and secondary airfoil 40 can be modified by changing the parameters $L_L$, $L_U$, $H_U$ and $D_L$ as the circumstances require.

The primary advantage of the improved design is that it enables the ring to travel in a relatively straight line over mid-range to long distances. It also has the advantage of being relatively easy to grasp and throw. When the ring 10 is grasped the thrower typically places his or her thumb on the upper flat portion 22 and engages the under side of the ring at the lower transition point 29 where the rounded section 20 blends into the flat bottom portion 26. It has also been found that the ring configuration is easier to catch since the fingers of the catching hand can completely wrap around the rim of the device.

It is also possible to change the flight characteristics of the ring by adding spoiler features to the primary airfoil to reduce lift and disturb laminar flow. For example, it is possible to make the transition point 29 from the rounded portion 20 to the flat section 26 somewhat discontinuous, e.g. stepped, so that some of the downward thrust is lost. This would produce a decreased downward thrust and a net overall lift effect. By increasing the angles of attack A1 and A2 the airflow can be made to spoil about the leading edge 16 of the ring 10 in the direction of travel 30. However, at the same time the airflow will not necessarily spoil on the working side 34 so that the primary airfoil 38 will still counterbalance and neutralize the excess lift of the secondary airfoil 40.

While the invention has been described with reference to the preferred embodiment thereof, it will be appreciated by those of ordinary skill in the art that various modifications can be made to the structure and materials employed in the invention without departing from the spirit and scope thereof.

I claim:

1. A spinning aerial apparatus which is suitable for throwing, including a ring having a top side, a bottom side and a circular opening in the center of the ring, said ring comprising:

a first airfoil including a substantially rounded cross-section on said bottom side and a substantially flat cross-section on said top side wherein a first lift component is created by said first airfoil when said apparatus is thrown, said first lift component lying in a direction which is approximately perpendicular to said substantially flat section toward said bottom side;

a second airfoil substantially concentric with said first airfoil, said second airfoil including a substantially rounded cross-section on said top side and a substantially flat cross-section on said bottom side wherein a second lift component is created by said second airfoil when said apparatus is thrown, wherein said second lift component is greater than and lies in a direction opposite to said first lift component, wherein the lift generated by said first airfoil counterbalances and neutralizes excess lift created by said second airfoil so the apparatus generates a net lift when thrown and is capable of stable flight on a substantially straight path.

2. The apparatus of claim 1 wherein said ring comprises a plastic-like material.

3. The apparatus of claim 2 wherein said ring comprises a Nylon ®-like material.

4. The apparatus of claim 3 wherein said first airfoil has a leading edge and a trailing edge, and said leading edge of said first airfoil has an angle of attack of approximately 40 degrees.

5. The apparatus of claim 4, wherein said second airfoil has a leading edge and a trailing edge, said trailing edge of said second airfoil has a trailing angle of approximately 16 degrees.

6. A recreational spinnable ring apparatus having a top surface, a bottom surface, a cross-section which includes a leading edge and a trailing edge, said apparatus comprising:

first annular portion having a relatively rounded cross-section located on said bottom surface;

first annular portion having a relatively flat cross-section located on said bottom surface;

second annular portion having a relatively rounded cross-section located on said top surface substantially opposite to said first annular portion having a relatively flat cross-section located on said bottom surface; and, second annular portion having a relatively flat cross-section located on said top surface substantially opposite to said first annular portion having a relatively rounded cross-section located on said bottom surface.

* * * * *